US005461800A

United States Patent [19]

Luthi et al.

[11] Patent Number: 5,461,800

[45] Date of Patent: Oct. 31, 1995

[54] MIDSOLE FOR SHOE

[75] Inventors: Simon Luthi; Xavier Kälin, both of Lake Oswego, Oreg.; Wolfgang Scholz, Lonnerstadt, Germany; Edgar Stüssi, Schlieren, Switzerland

[73] Assignee: adidas AG, Herzogenaurach, Germany

[21] Appl. No.: 280,208

[22] Filed: Jul. 25, 1994

[51] Int. Cl.[6] ..... A43B 13/18

[52] U.S. Cl. ..... 36/28; 36/28; 36/27; 36/114

[58] Field of Search ..... 36/28, 25 R, 7.8, 36/27, 31, 35 R, 114, 29, 38, 37; 267/292, 142, 145, 153

[56] References Cited

U.S. PATENT DOCUMENTS

| | | | |
|---|---|---|---|
| 1,498,838 | 6/1924 | Harrison, Jr. | 36/29 |
| 3,005,272 | 10/1961 | Shelare et al. | 36/29 |
| 4,198,037 | 4/1980 | Anderson | 267/153 |
| 4,535,553 | 8/1985 | Derderian et al. | 36/28 |
| 4,593,482 | 6/1986 | Mayer | 36/28 |
| 4,753,021 | 6/1988 | Cohen | 36/28 |
| 4,754,559 | 7/1988 | Cohen | 36/3 B |
| 4,782,603 | 11/1988 | Brown | 36/28 |
| 4,864,738 | 9/1989 | Horovitz | 36/29 |
| 4,914,836 | 4/1990 | Horovitz | 36/28 |
| 5,005,300 | 4/1991 | Diaz et al. | 36/31 |
| 5,117,566 | 6/1992 | Lloyd et al. | 36/28 |
| 5,280,890 | 1/1994 | Wydra | 267/220 |
| 5,337,492 | 8/1994 | Anderie et al. | 36/27 |

FOREIGN PATENT DOCUMENTS

| | | | |
|---|---|---|---|
| 958766 | 3/1950 | France . | |
| 2088626 | 1/1972 | France . | |
| 331247 | 10/1935 | Italy | 36/28 |

*Primary Examiner*—Steven N. Meyers

*Attorney, Agent, or Firm*—Klarquist Sparkman Campbell Leigh & Whinston

[57] ABSTRACT

An integrally molded midsole for an athletic shoe having tubular suspension members is disclosed. The tubular suspension members behave as springs and have spring constants which may be designed for a particular application by choice of the tube length, the tube wall thickness or the hardness of the tube material. Preferably, the midsole is made of an elastomer such as HYTREL that is cast in a preformed shape and thereafter subjected to substantial compressive forces so that the tubular springs take a compression set and thereafter perform as near-ideal springs.

2 Claims, 3 Drawing Sheets

MIDSOLE FOR SHOE

BACKGROUND OF THE INVENTION

1. Field of the Invention

The present invention relates to soles for shoes and more particularly relates to a midsole for an athletic shoe.

2. Description of Related Art

Soles in athletic shoes are expected to provide shock absorption and stability. Shock absorption minimizes the impact of a runner's footfalls to lessen stress on the leg muscles and joints. Stability is necessary to control the amount of lateral motion of a foot in order to prevent over pronation thereby lessen the stress on the lower legs.

During normal motion, the foot of a typical runner hits the ground heel first. The foot then rolls forwardly and inwardly over the ball of the foot. During the time that the foot is moving from heel strike to the ball of the foot, the foot is typically rolling from the outside or lateral side, to the inside or medial side of the foot; a process called pronation. After the ball contacts the ground, the foot continues rolling forward onto the toes. During motion through ball and toe contact, the foot rotates outward as the toes prepare to push off; a process called supination. The foot remains supinated while it is lifted off the ground between footfalls.

Pronation, the inward roll of the foot in contact with the ground, although normal, can be a potential source of foot and leg injury if it is excessive. Many prior art soles have been designed with the goal of preventing over pronation and controlling supination. The lateral motion of the foot, that is abduction and adduction, can be controlled by providing a stable sole. However, as the stability of the sole increases, the shock absorption properties of the sole decrease. Thus, soles must be designed to properly balance the properties of stability and shock absorption to provide optimum characteristics for both parameters. This design goal is further complicated by the fact that foot size is largely unrelated to body mass. For example, two people of equal weight may have feet that are two or three sizes apart and conversely, two people with the same foot size may have substantially different body mass. Thus, a shoe that is stable for a 130 pound, size 9 runner may not be stable for a 160 pound, size 9 runner.

Durability of the midsole, as measured by its ability to withstand cyclical loading without degradation of midsole properties, is also an important design goal. Most present-day athletic shoes use a midsole of an elastomeric foam, such as ethylene vinyl acetate (EVA). EVA foam allows designers to adjust the density, and hence the hardness, of the foam to provide various midsole properties in an attempt to balance shock absorption and stability. As is well-known to those skilled in the art, the higher-density EVAs provide a stable platform but less shock absorption, while the low-density EVA foams provide better shock absorption but less stability because they cannot control the lateral movement of the foot. EVA foams typically have a useful life of approximately 800,000 cycles before there is a noticeable degradation in their performance. For these and other reasons, there is a continuing search for alternative midsole designs.

Cohen, U.S. Pat. Nos. 4,753,021 and 4,754,559, discloses a midsole for a shoe having a sheet of rubber-like material with a plurality of ribs separating an upper and lower surface. As a load is applied to the midsole the ribs collapse thereby absorbing energy. As a load is removed the resilient nature of the ribs causes them to spring back to their previous shape. Cohen discloses plural embodiments including those in which the ribs form channels that are arranged parallel to, and orthogonal to a longitudinal axis of the elongate sole. Because of the design and choice of materials, Cohen would not represent an enhanced performance sole for use in an athletic shoe.

SUMMARY OF THE INVENTION

The present invention seeks to provide a midsole having superior stability and shock absorption properties in a midsole design that can be customized for different applications and body-type characteristics. In addition the present invention seeks to provide a high performance midsole having superior durability.

A preferred embodiment of the present invention provides a molded midsole formed of an elastomer whose ration of plastic deformation to elastic deformation is greater than 1.5 to 1. Preferably, the elastomer is a copolyester polymer elastomer such as that manufactured and sold by E. I. dupont de Nemours under the trademark HYTREL. The present invention has been cyclically loaded to 1.2 million cycles before suffering a degradation of performance. This represents a 50% increase in useful life over typical prior art EVA foam soles.

In the preferred embodiment, the midsole is an integral, one-piece-molded midsole having a curvilinear, elongate top surface and a plurality of integrally molded, transversely arranged tubes which individually function as compression spring elements. A lower surface is integrally molded with the lower portion of the tubes thereby providing more structural integrity for the midsole and providing a surface upon which an outer sole may be applied.

The performance properties of the midsole can be controlled by changing the spring constant of the tubes such as by increasing the wall thickness of the tubes, increasing the tubes' length or the hardness of the material. For example, in the heel section of a preferred embodiment, short tube segments are provided along lateral and medial edges of the midsole thereby providing a central opening having no tubes therein. The midsole can be designed so that the tubes along the medial edge have thicker wall sections, or are slightly longer, than the tubes along the lateral edge, thereby creating a higher spring constant and providing control for over pronation. Also, a preferred embodiment includes forefoot tubes having slit-like openings along their length to permit a great deal of midsole flexibility along the longitudinal direction. Additionally, the wall thickness of the forefoot tube can be greater along the medial edge than the lateral edge, or vice versa, to provide lateral stability for different types of runners, e.g., over pronators.

In other preferred embodiments of the invention the midsole is manufactured in two pieces comprising a forefoot section and a rearfoot section. Each individual section would substantially resemble its respective portion of the one-piece integrally molded midsole. However, by manufacturing the midsole in two pieces it may be possible to reduce the number of manufacturing molds. Additionally, it would be possible to mix properties between various rearfoot sections and forefoot sections. For example, a rearfoot section designed for a heavy heelstrike-type runner and having good shock absorption could be combined with a forefoot section providing substantial stability against over pronation.

Various advantages and features of novelty which characterize the invention are particularized in the claims forming a part hereof. However, for a better understanding of the invention, its advantages, and objects obtained by its use, reference should be had to the drawings which form a part hereof and to the accompanying descriptive matter in which there is illustrated and described preferred embodiments of the invention.

DETAILED DESCRIPTION OF THE PREFERRED EMBODIMENTS

Figure 1:
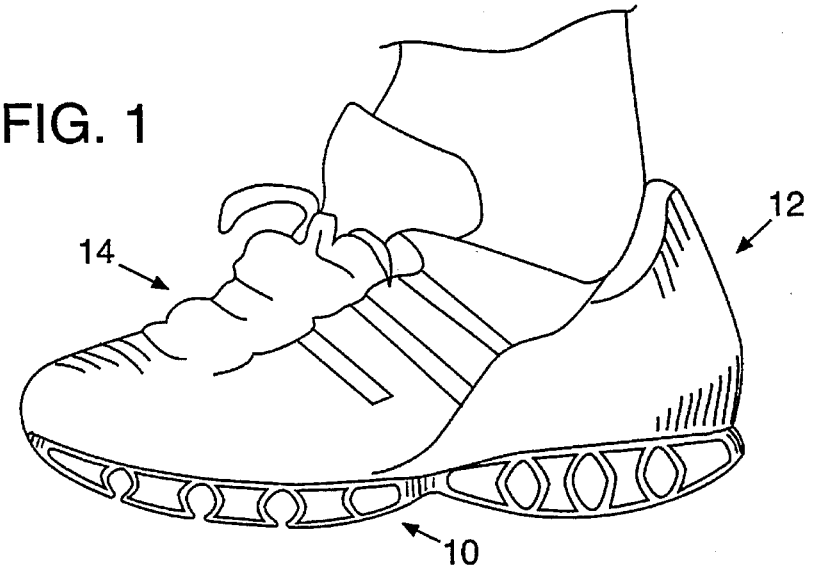
FIG. 1 is a side view of a running shoe worn by a runner.
Figure 2:
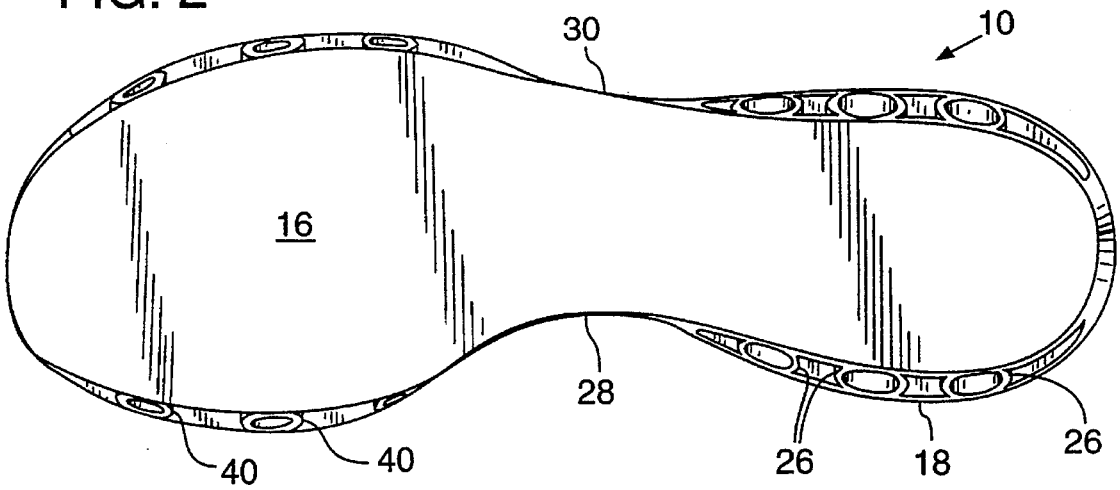
FIG. 2 is a top plan view of a preferred embodiment of a midsole of the present invention.
Figure 3:
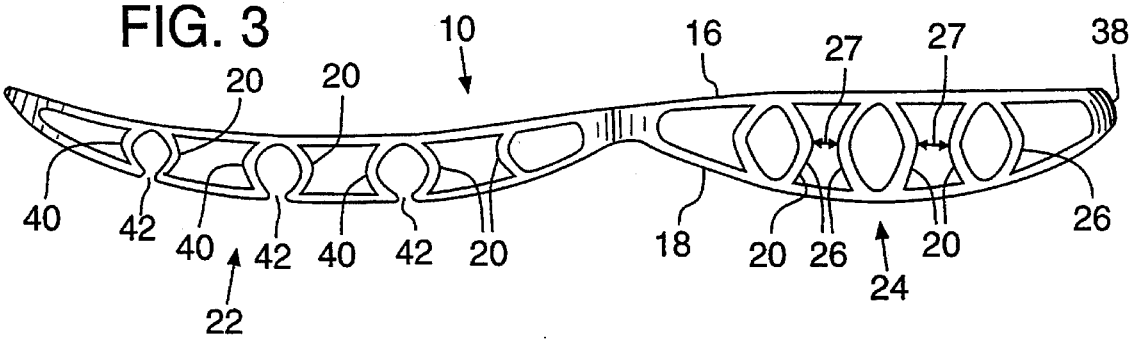
FIG. 3 is a side elevation view taken of the midsole of FIG. 2.

FIG. 1 shows a midsole 10 of the present invention in its preferred environment as a midsole for an athletic shoe 12 to be worn by a runner or the like. Typically, the shoe 12 is attached to the runner's foot by a lacing system 14.

With reference to FIGS. 2–8, a preferred embodiment of the midsole 10 is shown as a one-piece, injection-molded elastomer having a top surface 16, a bottom surface 18, and a plurality of structural webs 20 that extend between the top surface 16 and the bottom surface 18. Preferably, the structural webs 20 form a tubular structure that is integrally formed with the top and bottom surfaces.

Figure 4:
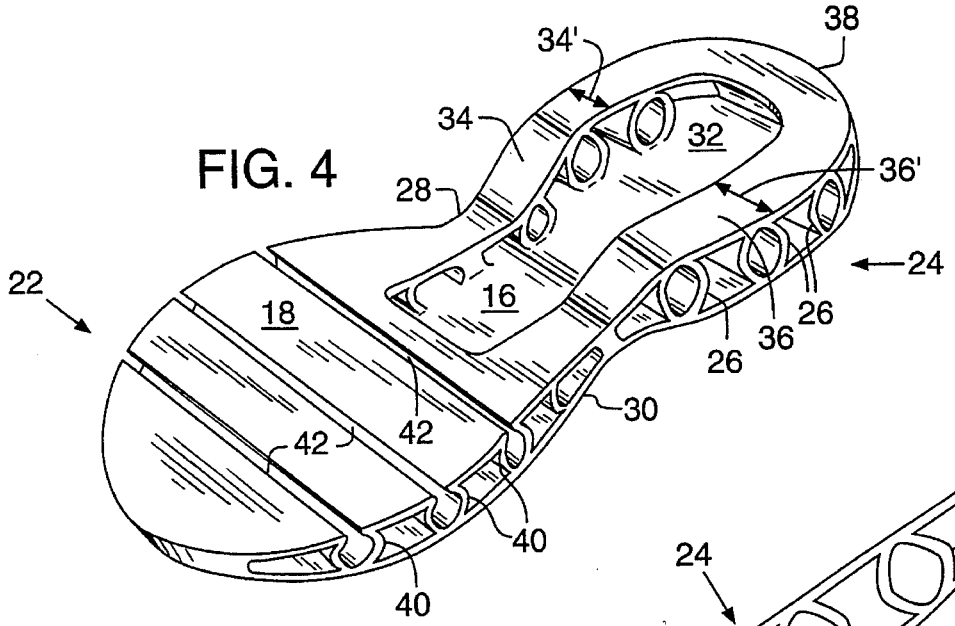
FIG. 4 is a perspective bottom view of a preferred embodiment of a midsole of the present invention.

Conceptually, the midsole 10 can be divided into a forefoot section 22 and a heel section 24. Preferably, the structural webs 20 along the heel section 24 form heel tubes 26 that extend inward from a medial edge 28 and from a lateral edge 30. As best shown in FIG. 4, a preferred embodiment of the present invention has discontinuous heel tubes 26 that extend from the medial and lateral edges 28 and 30, respectively, toward a central region 32 of the midsole having no tubes therein. The central region is bounded by heel tubes 26, bottom surface 18 and top surface 16. Further, in the heel section 24, the bottom surface 18 forms a "U"-shaped surface having legs 34 and 36 that extend from a rear tip 38 of the midsole toward the forefoot section 22. Associated with each leg 34, 36 is a width 34', 36', the significance of which will be explained below. Other embodiments of the heel section 24 may include heel tubes 26 that are continuous between the medial and lateral edges 28, 30, in which the case the bottom surface 18 would extend substantially over the heel section 24 and there would be no tubeless central region 32.

Figure 6:
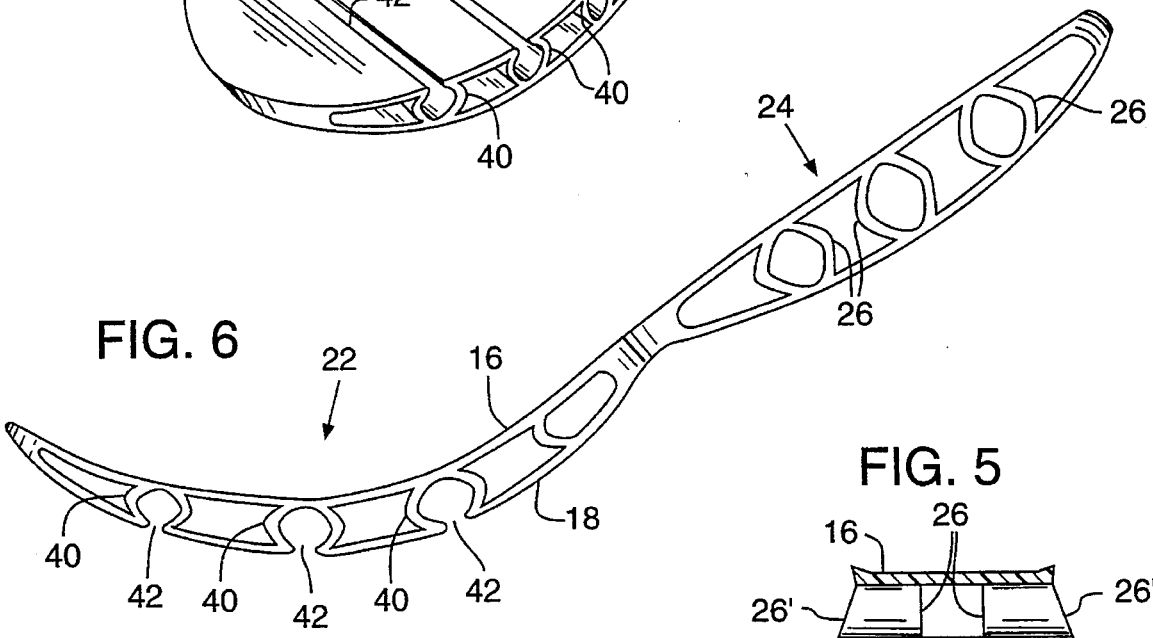
FIG. 6 is a side elevation view wherein a midsole is flexed along a forefoot portion.

The forefoot section 22 similarly comprises the integrally formed top surface 16, bottom surface 18 and intermediate structural webs 20. As with the heel section, the structural webs 20 preferably form elongate tubular members 40, hereinafter referred to as the forefoot tubes 40. In the preferred embodiment the forefoot tubes 40 have slit-shaped openings 42 that extend along the length of the forefoot tubes. The openings 42 permit substantial longitudinal flexibility in the forefoot section 22. In FIG. 6, the midsole 10 is shown with the forefoot section 22 flexed, and the slit openings 42 are shown spread open from their relaxed state. Substantial flexibility of the forefoot section along its longitudinal direction is a desirable property so that the athletic shoe 12 does not inhibit the natural tendency of the foot to roll from the heel onto the ball of the foot and onto the toe for push-off as the runner goes through a stride. The bottom surface is discontinuous at the openings 42.

Figure 9:
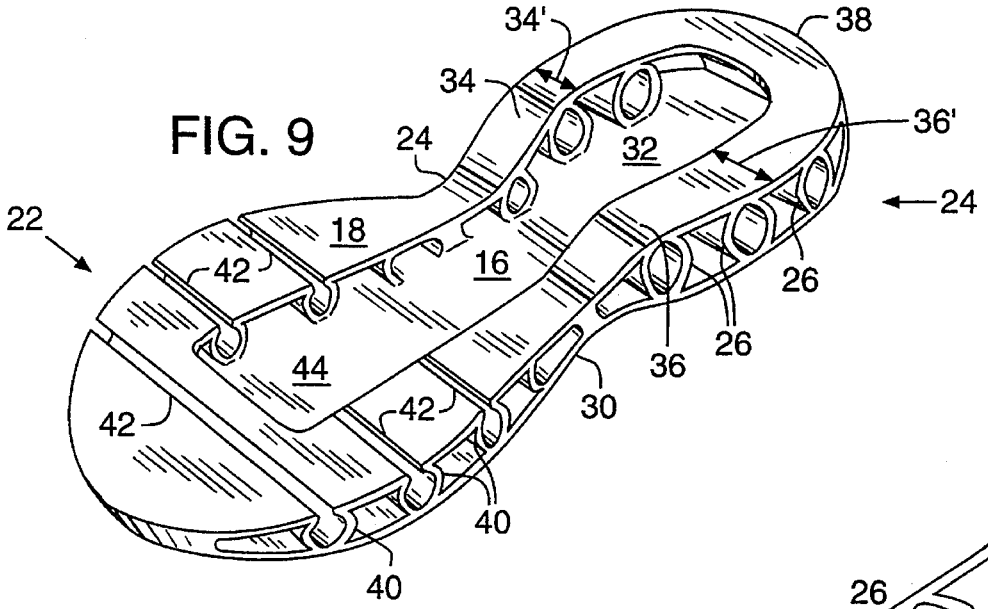
FIG. 9 is a bottom perspective view of a midsole of an alternative embodiment of the present invention.
Figure 10:
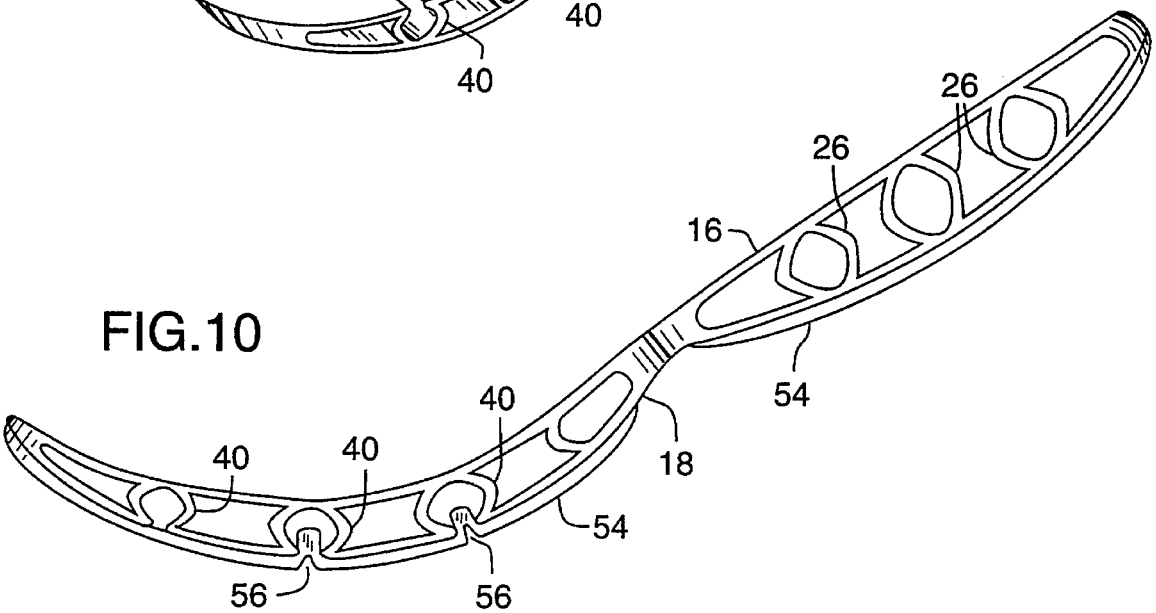
FIG. 10 is a side elevation view of the midsole and further showing an attached outer sole.

In a preferred embodiment shown in FIG. 4, the forefoot tubes 40 extend continuously from the medial edge 28 to the lateral edge 30. In an alternative embodiment, shown in FIG. 9, the forefoot tubes 40 are discontinuous between the medial and lateral edges, thereby forming a central forefoot region 44 having no tubes therein. The bottom surface 18 forms a "U"-shaped surface around the central forefoot region 44 thus forming legs 46 and 48 having widths 46' and 48', respectively. The significance of the leg widths 46', 48' will be explained below. By forming the tubeless central forefoot region, the forefoot section becomes more flexible laterally.

Preferably, the entire midsole is injection molded as one integral piece of an elastomer having a tensile characteristic such that the ratio of plastic strain to elastic strain is greater than 1.5 to 1. One such elastomer is a copolyester polymer elastomer manufactured and sold by E. I. dupont de Nemours under the trademark HYTREL. HYTREL is reasonably inert and significantly, it is quite durable. Moreover, HYTREL is not subject to tear propagation even when made in relatively thin cross-sections. The preferred embodiments of the midsole use duPont's HYTREL composition number 5556. For a more complete description of this elastomer, see U.S. Pat. No. 4,198,037 and references cited therein. U.S. Pat. No. 4,198,037 is hereby incorporated herein by reference.

As noted, the midsole 10 is preferably injection molded of HYTREL. It is well known that HYTREL will take a compression set. For this reason, the midsole of the present invention is molded into a preform and is subsequently compressed to take that set. As is taught in U.S. Pat. No. 5,280,890, compression of the HYTREL material also results in orientation of the molecular structure and enhances the spring characteristics of the material.

Figure 7:
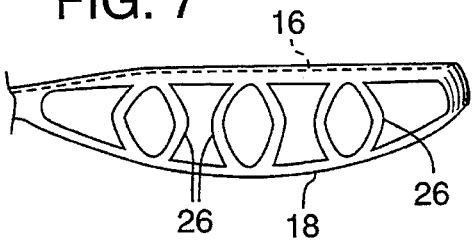
FIG. 7 is a detail of a side elevation view of a preform heel portion of a midsole of the present invention.
Figure 8:
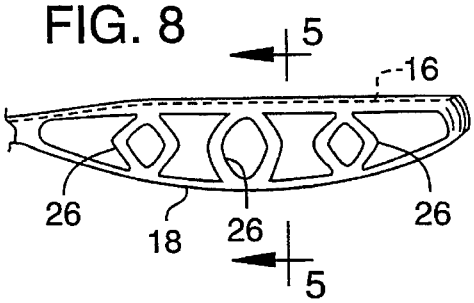
FIG. 8 is a detail of a side elevation view of a heel portion of a midsole of the present invention.

The effect of this compression is illustrated in FIGS. 7 and 8. FIG. 7 illustrates the preform configuration, wherein the heel tubes 26 have been preformed into an oval cross-section so the tubes 26 are "tall,+ thereby providing a greater separation between the top surface 16 and the bottom surface 18. After the preform has been removed from the mold and annealed at room temperature for up to 24 hours. It is then compressed, preferably to a solid position. That is, the top surface 16 is pressed toward the bottom surface 18 thus radially compressing the heel tubes 26 and forefoot tubes 40. The midsole is compressed until it is "solid," wherein further force will not further move the surfaces together.

Upon release of the compressive force, the tubes 26, 40 will partially spring back to a somewhat circular configuration as shown in FIG. 8. The midsole takes a "set" in this position. Thereafter, the tubes 26, 40 may be partially compressed during use by the runner, but as the runner's weight is removed, the springs will completely return to their set configuration, such as is shown in FIG. 8. A complete description of the compression set procedure is provided in U.S. Pat. No. 5,280,890, which is hereby incorporated by reference.

The heel tubes 26 and the forefoot tubes 40 have the characteristics of springs and therefore have a measurable spring constant. It has not yet been determined whether the spring constant for the tubes of the present invention is a constant, or a function of the amount of compressive travel of the tubes. Furthermore, it has not yet been determined what the proper spring constant would be for the various configurations disclosed herein. However, it is known that various modifications to the configurations disclosed herein will affect the spring constant of the so that the midsole 10 can be designed for particular types and weights of runners after empirical data has been collected.

The spring constant of the tubes can be increased by providing a longer tube. When the midsole 10 is loaded, the surfaces 16, 18 will move towards one another, thereby radially compressing the tubes under the given load. Obviously, a one-inch tube will radially compress more than a two-inch tube in length under the same load. Thus, the longer tube will have a higher spring constant. In the context of an athletic shoe, the higher spring constant means that the tube will provide greater stability but less cushioning.

The tubes 26, 40 have wall thicknesses 50 and 52, respectively which also affect the spring constants. A thicker wall thickness 50 or 52 will produce a higher spring constant. In the preferred embodiment of the present invention, the wall thickness of a particular heel tube 26 is constant along the length of the tube. The wall thickness of the forefoot tubes 40 varies between the medial edge 28 and the lateral edge 30, preferably in a step-wise fashion, wherein the wall thickness would be a constant along a portion of the forefoot tube 40, and the wall thickness would jump to a different thickness at some point along the length of the tube. Alternatively, it is envisioned that any of the tubes could be provided with a tapering wall thickness wherein the wall thickness changes gradually from one end to the other of a particular tube.

The preferred embodiment includes a two-stage spring constant in the heel section 24. The heel tubes 26 have a spacing 27 between the opposite walls of adjacent tubes. The spacing 27 is chosen so that those opposing walls touch as the tubes 26 are compressed. Further compression causes the tubes to press against each other thereby limiting the motion of the tube walls and changing the spring constant for further loading. Thus, the heel tubes 26 have an initial spring constant at the onset of compression and after the opposing walls of adjacent tubes make contact, the tubes have a different, higher spring constant.

It is envisioned that the ability to control the spring constants can be used in various combinations to precisely control the performance characteristics of the midsole. For example, in a preferred embodiment of the present invention, the heel tubes 26 are provided with a constant wall thickness, but the width 36' of the lateral leg 36 could be less than the corresponding width 34', thereby placing shorter tubes 26 on the lateral side 30 as compared to the tubes on the medial side 28. This configuration would create a shoe having a higher spring constant along its medial edge to resist over pronation. In a preferred embodiment, the width 36' is approximately 24 mm and the width 34' is approximately 26 mm.

Furthermore, the spring constant of the forefoot tubes 40 may be tailored by providing thicker wall sections in the tubes 40 in the regions proximate the medial edge 30 as compared to the wall thickness of the tubes 40 in the region close to the lateral edge 28. The varying wall thicknesses can be incorporated into the embodiments shown in FIG. 4 and FIG. 9.

Figure 5:
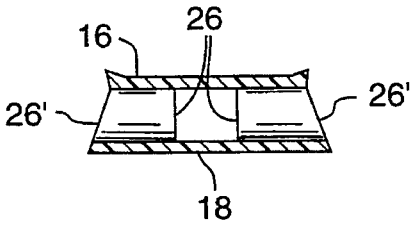
FIG. 5 is an elevational cross-section taken along lines 5—5 of FIG. 8.

As is shown in FIG. 5, the heel tubes 26 are provided with beveled ends 26' so that the transverse width of the bottom surface 18 is greater than the transverse width of the top surface 16 at any particular point along the longitudinal length of the midsole 10. By providing a wider bottom surface, the midsole is able to provide greater stability for the athletic shoe 12.

In the preferred embodiment of the present invention, the midsole 10 is provided with an outer sole 54, which is affixed to the bottom surface 18. Preferably, the outer sole 54 is made of a material having a high scuff resistance and substantial durability. Preferably, the outer sole 54 is provided with expansion joints 56 that cover one or more of the slit openings 42, thereby allowing the forefoot section to flex and permitting the slit openings to expand.

Figure 11:
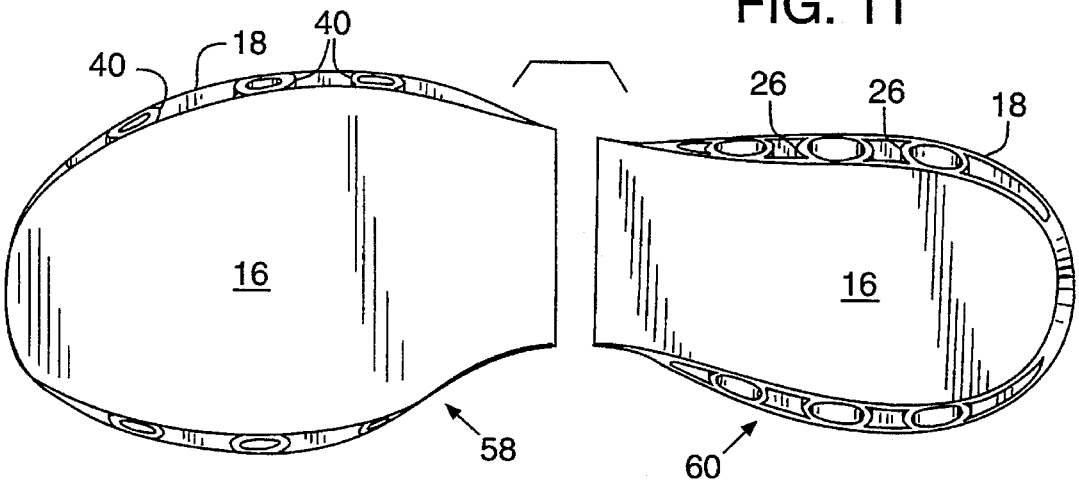
FIG. 11 is a top plan view of an alternative embodiment of the midsole of the present invention.

An alternative embodiment may include the midsole of the present invention fabricated into two sections. As shown in FIG. 11, the two sections would comprise a forefoot section 58 and a rearfoot section 60.

Making the midsole 10 into two sections provides numerous advantages. It may be possible to cut down on the number of molds necessary to provide midsoles for the full range of shoe sizes. For example, it may be possible to provide three different sizes of heel sections 60, while providing five different sizes of forefoot sections 58. The various sections can be mixed to provide the full range of shoe sizes.

Also, by providing a midsole in two sections, it is possible to design sections to meet specific performance requirements. For example, a rearfoot section 60 may be designed for a size 9, 150-pound runner having a substantial over pronation problem, and another heel section 60 may be designed for a size 9, 150-runner who under pronates. Likewise, the spring constants in the forefoot section 58 can be specifically tailored to different runners and performance characteristics.

The optimum values for the design parameters stated herein will be determined after extensive empirical data is collected. At present, the specific design parameters, such as, for example, optimum heel tube thickness and length for an over-pronating, 150 pound runner are unknown, and it is envisioned that physical testing will be necessary to determine such parameters.

Numerous characteristics and advantages of the invention have been set forth in the foregoing description, together with details of the structure and function of the invention. The novel features hereof are pointed out in the appended claims. The disclosure is illustrative only, and changes may be made in detail, especially in matters of shape, size, and arrangement of parts within the principle of the invention to the full extent indicated by the broad general meaning of the terms in the claims.

What is claimed:

1. A sole for an athletic shoe, comprising:

(a) an elongate, flexible top plate having a forefoot portion, a heel portion, and a midfoot portion, the top plate having a upper surface and a lower surface, the top plate further having a medial margin and a lateral margin;

(b) at least one tube located on the lower surface of the top plate along the heel portion and having a major axis along a center of an opening of the tube and wherein the tub is integrally formed with the top plate;

(c) at least one elongate tube located on the lower surface of a top plate along the forefoot portion and having a longitudinal axis along a center opening of the tube wherein the tube is integrally formed with the top plate;

(d) a flexible bottom plate integrally formed with the tubes and the top plate and arranged so that the at least one forefoot tube is located between the top plate and the bottom plate along the forefoot portion, and the at least one heel tube is located between the top plate and the bottom plate along the heel portion, and the top plate and the bottom plate are in integral contact at the midfoot portion; and (e) an undersole fixedly connected to the bottom plate and including an expansion joint that is located coincident with a slit-shaped aperture located along the length of the at least one forefoot tube.

2. A sole for an athletic shoe, comprising:

(a) an integrally formed rearfoot piece having a top plate, a bottom plate, and a plurality of tubes located between the top plate and the bottom plate;

(b) an integrally formed forefoot piece having a top plate having a medial and a lateral margin, a bottom plate, and a plurality of elongate tubes located between the top plate and the bottom plate wherein the tubes each define a slit-shaped aperture along the length thereof, thereby forming longitudinal edges that are integral with the bottom plate, and wherein the bottom plate is discontinuous at the longitudinal edges of the forefoot tubes; and (c) an outer sole attached to the bottom plates and having an expansion joint coincident with at least one slit-shaped aperture.

* * * * *

UNITED STATES PATENT AND TRADEMARK OFFICE

CERTIFICATE OF CORRECTION

PATENT NO. : 5,461,800

DATED : October 31, 1995

INVENTOR(S) : Simon Luthi et al.

It is certified that error appears in the above-indentified patent and that said Letters Patent is hereby corrected as shown below:

Column 1, line 14, "thereby lessen" should read --thereby lessening--.

Column 2, line 17, "whose ration" should read --whose ratio--.

Column 3, line 64, "in which the case" should read --in which case--.

Column 4, line 55, "tall,+ thereby" should read --tall, thereby--.

Column 4, lines 58-59, "24 hours. It is then" should read --24 hours, it is then--.

Column 5, line 17, "of the so" should read --of the tubes so--.

Column 6, line 42, "150-runner" should read --150-pound runner--.

Column 6, line 49, "150 pound" should read --150-pound--.

Column 6, line 66, "a upper" should read --an upper--.

Signed and Sealed this

Second Day of July, 1996

Bruce Lehman

*Attest:*

BRUCE LEHMAN

*Attesting Officer*

*Commissioner of Patents and Trademarks*